US005938627A

United States Patent [19]

Hickman

[11] Patent Number: 5,938,627

[45] Date of Patent: Aug. 17, 1999

[54] MASSAGE THERAPY DEVICE PRODUCING PULSATING MASSAGE ON A USER'S TORSO

[76] Inventor: Tommie N. Hickman, 6845 S. Evans, Chicago, Ill. 60637

[21] Appl. No.: 08/879,055

[22] Filed: Jun. 19, 1997

[51] Int. Cl.[6] ..... A61H 9/00

[52] U.S. Cl. ..... 601/149; 601/152

[58] Field of Search ..... 601/149–152; 602/13; 606/202

[56] References Cited

U.S. PATENT DOCUMENTS

| | | | |
|---|---|---|---|
| 1,608,239 | 11/1926 | Rosett | 601/152 |
| 1,795,893 | 3/1931 | Rosett | 601/148 |
| 2,361,242 | 10/1944 | Rosett | 601/152 |
| 2,571,461 | 10/1951 | Livingston et al. | 606/202 |
| 4,310,927 | 1/1982 | DeBose | 2/115 |
| 4,513,451 | 4/1985 | Brown | 2/69 |
| 4,583,522 | 4/1986 | Aronne | 601/149 X |
| 4,590,925 | 5/1986 | Dillon | 601/152 |
| 5,303,425 | 4/1994 | Mele | 2/115 |
| 5,381,558 | 1/1995 | Lo | 2/115 |
| 5,391,141 | 2/1995 | Hamilton | 601/151 |
| 5,490,820 | 2/1996 | Schock et al. | 601/151 X |

FOREIGN PATENT DOCUMENTS

| | | | |
|---|---|---|---|
| 2064330 | 6/1981 | United Kingdom | 601/152 |
| 88008291 | 11/1988 | WIPO | 601/151 |

*Primary Examiner*—Danton D. DeMille
*Attorney, Agent, or Firm*—Henderson & Sturm

[57] ABSTRACT

A pneumatic massage therapy device 10 for massaging an individual's torso wherein the device 10 includes a vest member 20 provided with a branched inflatable tubing unit 12 operatively connected to massage disks 30. A pulsating pneumatic force is provided to the branched tubing unit 12 to move the massage disks 30 in a massaging motion relative to the user's torso.

1 Claim, 2 Drawing Sheets

MASSAGE THERAPY DEVICE PRODUCING PULSATING MASSAGE ON A USER'S TORSO

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of massaging devices in general, and in particular to a pulsating inflatable garment used to massage a user's upper torso.

2. Description of Related Art

As can be seen by reference to the following U.S. Pat. Nos. 4,310,927; 4,513,451; 5,303,425; and 5,381,558; the prior art is replete with myriad and diverse articles of clothing that are ventilated, inflated, or provided with massaging protuberances.

While all of the aforementioned prior art constructions are more than adequate for the basic purpose and function for which they have been specifically designed, no one to date has combined the foregoing technologies into a single garment that will provide a pulsating massage to the wearer of the garment.

As most people are aware, a massage has many therapeutic and beneficial effects, including but not limited to, muscle relaxation, stress relief and mental rejuvenation for the person receiving the massage.

As a consequence of the foregoing situation, there has existed a longstanding need for a new type of massage device that will allow a person to automatically control the duration, strength, and interval between applications of a massaging force being exerted upon their upper torso by a body worn massaging device, and the provision of such a construction is a stated objective of the present invention.

BRIEF SUMMARY OF THE INVENTION

Briefly stated, the massage therapy device that forms the basis of the present invention comprises in general, a garment unit provided with an inflatable tubing unit operatively connected to a pneumatic unit. The inflatable tubing unit is provided with a plurality of massaging elements which are pressed against a user's torso in a sequence, intensity and duration which is dictated by the pneumatic unit.

As will be explained in greater detail further on in the specification, the massage therapy device allows the user to essentially program the parameters of a massaging effect that will be produced on the user's torso by the cooperation between the aforementioned units.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figures 1, 2:
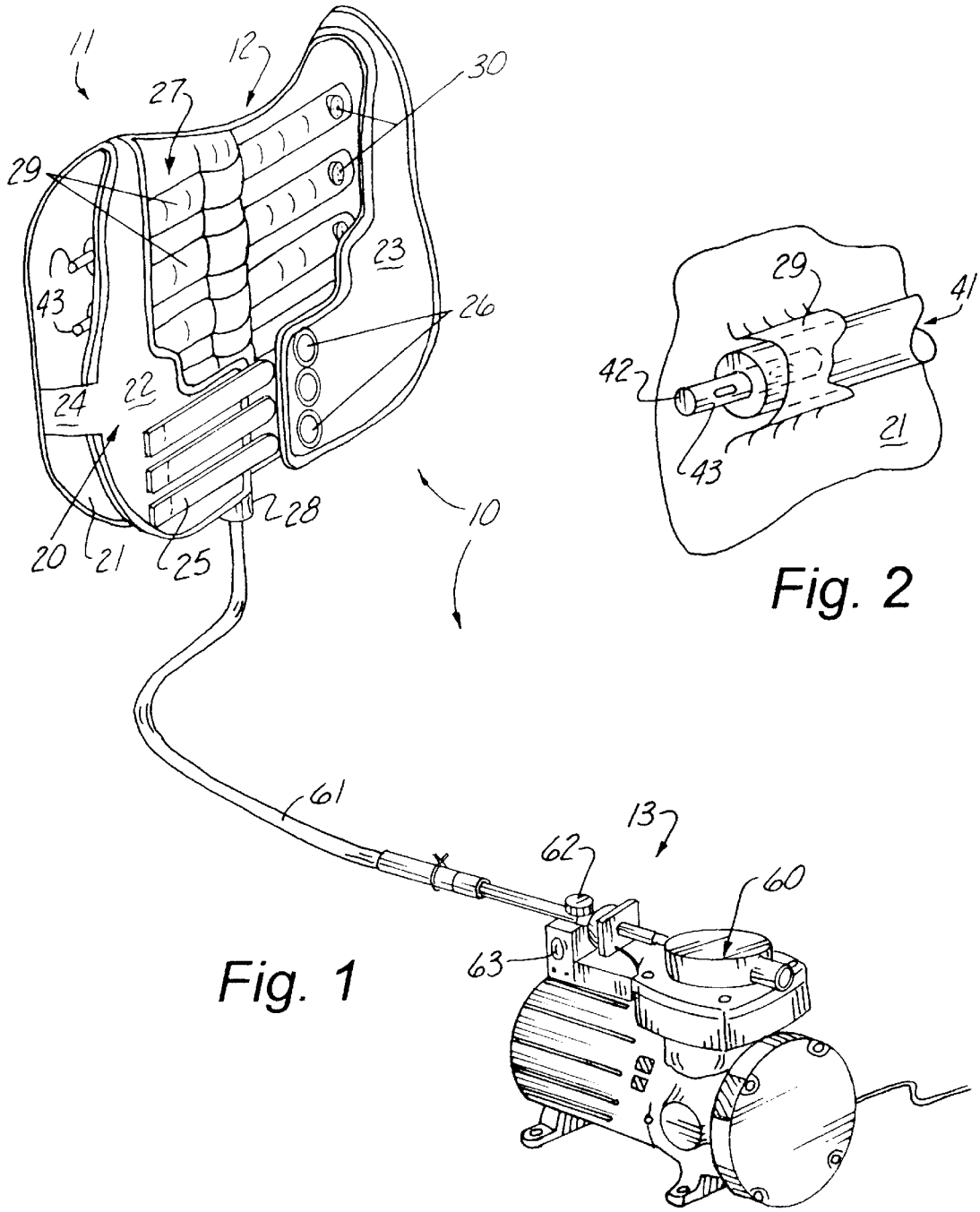
FIG. 1 is a perspective view of the massage therapy device that forms the basis of the present invention.
FIG. 2 is an isolated detail view of a relief valve arrangement contemplated for use in conjunction with this invention.

As can be seen by reference to the drawings, and in particularly to FIG. 1, the pneumatic massage therapy device that forms the basis of the present invention is designated generally by the reference number 10. The device 10 comprises in general a torso encircling garment unit 11, a branched inflatable tubing unit 12 and a pneumatic unit 13. These units will now be described in seriatim fashion.

Figure 3:
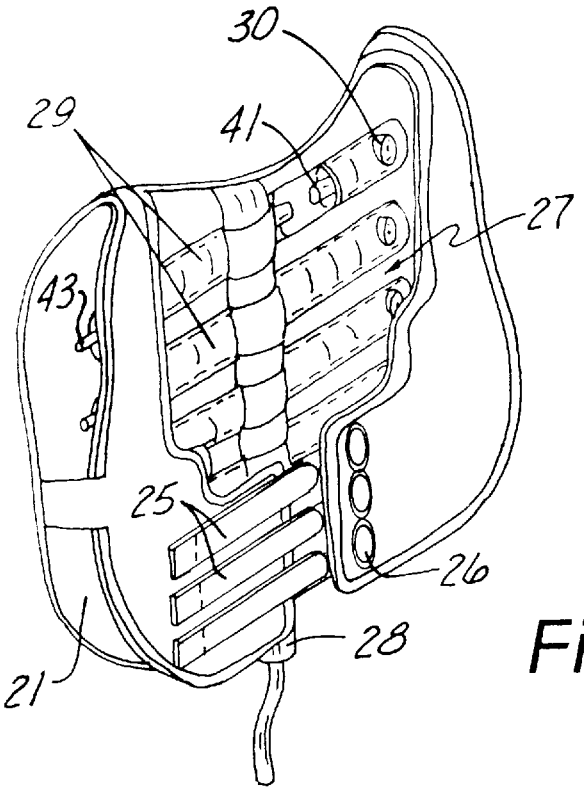
FIG. 3 is an isolated view of the torso encircling garment unit.

As shown in FIGS. 1 and 3, the torso encircling garment unit 11 comprises a vest member 20 having a rear panel 21 and a pair of front panels 22, 23 which are joined to the rear panel by side straps 24 and which are joined to one another by a plurality of releasable strap fasteners 25 which engage cooperating fastener receiving elements 26 such as D-rings, or the like.

In addition, the rear panel 21 of the vest member 20 is provided with a branched fabric covering 27 which surroundingly engages the inflatable tubing unit 12. The branched fabric covering 27 has a main trunk portion 28 and a plurality of outwardly extending branch portions 29 which are provided with semi rigid massaging disk 30 disposed proximate the outboard end of each branch portion 29.

Figure 4:
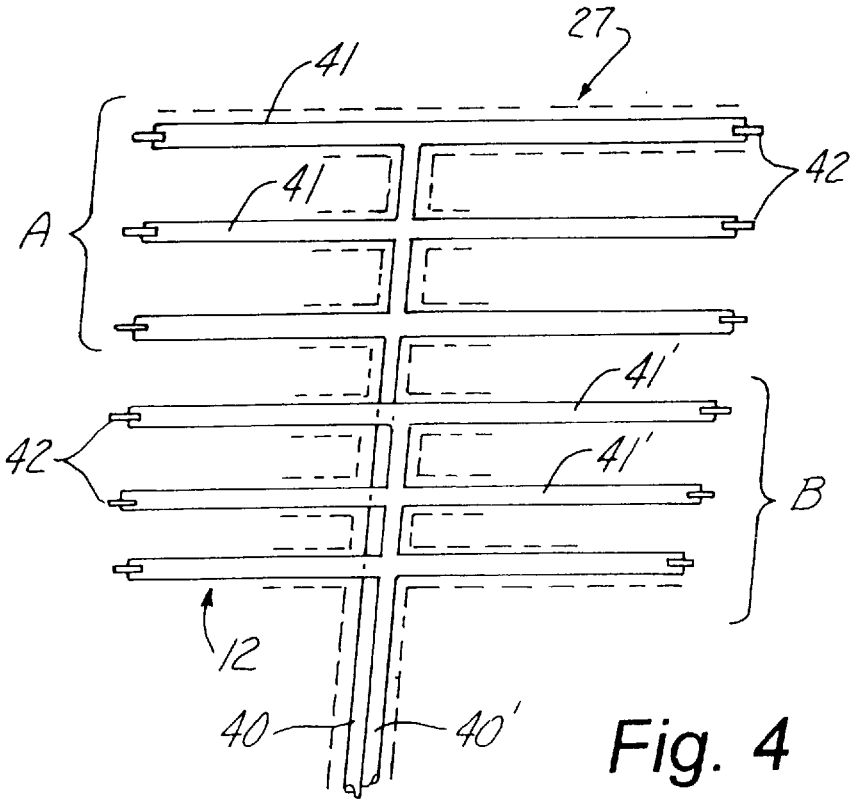
FIG. 4 is an isolated view of a dual zone inflatable tubing unit contemplated for use in the invention.

As can best be appreciated by reference to FIGS. 2 through 4, the branched inflatable tubing unit 12 comprises a pair of vertical trunk tubing members 40, 40' wherein each trunk tubing member 40, 40' is provided with a plurality of outwardly extending tubing branch elements 41, 41'. The longer trunk tubing member 40 and tubing branch elements 41 define an upper massage zone A, and the shorter trunk tubing member 40' and tubing branch elements 41' define a lower massage zone B.

In addition, as shown in FIG. 2, the outboard end of each of the tubing branch elements 41, 41' are provided with a relief valve element 42 having one or more pressure relief apertures 43, whose purpose and function will be described in greater detail further on in the specification.

Returning once again to FIG. 1, it can be seen that the pneumatic unit 13 comprises a pneumatic dual action pulsating compressor member 60 operatively connected to the vertical trunk tubing members 40, 40' by a pneumatic hose 61. The compressor member 60 is provided with control knobs 62 and 63 which govern the compressor pressure and the adjustable timed pulse sequence of the compressor 60 in a well recognized fashion.

The primary purpose of the pneumatic unit 13 is to intermittently supply compressed air through the pneumatic hose 61 to the inflatable tubing unit 12 to inflate and deflate the inflatable tubing unit 12 such that the tubing branch elements 41, 41' will expand and contract within the branch portions 29 of the branched fabric covering 27 to impart a pulsating action to the massaging disks 30 against the user's torso.

As was previously mentioned, the inflatable tubing unit 12 of the preferred embodiment is divided into an upper A and a lower B massaging zone. The pressure differential between the zones, and within individual zones, may be varied by the selective positioning of the relief valve elements 42 on selected tubing branch elements 41, 41'.

As a consequence of the foregoing situation, it is possible for a user of the device 10 to customize both the intensity, duration, and frequency of the massaging effect produced by the device 10 by the selective manipulation of the control knobs 62 and 63 as well as the positioning of the individual relief valve elements 42.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A pneumatic therapy device for producing a pulsating massage effect on a user's torso, wherein the massage therapy device consists of:

a torso encircling garment unit having a rear panel and at least one front panel wherein said at least one panel is provided with a branched fabric sleeve which operatively connects said inflatable tubing unit to said panel;

an inflatable tubing unit operatively associated with one of said panels;

massage means operatively associated with said inflatable tubing unit; and a pulsating pneumatic unit operatively associated with said inflatable tubing unit for imparting a pulsating force to said massage means relative to said user's torso wherein said massage means comprises a plurality of generally rigid massaging disks operatively associated with the outboard ends of said tubing branch elements; said inflatable tubing unit includes a pair of vertical trunk tubing members and each of said vertical trunk tubing members are operatively connected to said pneumatic unit and further provided with a plurality of outwardly extending tubing branch elements; at least selected ones of said tubing branch elements are provided with pressure relief valves; said pneumatic unit includes a dual action pulsating compressor member operatively connected to said vertical trunk tubing members via a pneumatic hose; and wherein the compressor member is provided with control means for governing the compressor pressure as well as the timed pulse sequence of the compressor.

* * * * *